United States Patent [19]

Beghi

[11] 3,972,508

[45] Aug. 3, 1976

[54] TAKE-UP ACTUATOR

[75] Inventor: René Beghi, Bois Colombes, France

[73] Assignee: Societe des Grands Travaux de Marseille, Nanterre, France

[22] Filed: Dec. 16, 1974

[21] Appl. No.: 532,926

[30] Foreign Application Priority Data

Dec. 21, 1973 France ..... 73.46096

[52] U.S. Cl. ..... 254/29 A

[51] Int. Cl.[2] ..... F21B 19/00

[58] Field of Search ..... 254/29 A; 29/452; 52/223 R

[56] References Cited

UNITED STATES PATENTS

| | | | |
|---|---|---|---|
| 3,647,184 | 3/1972 | Vanderhurst | 254/29 A |
| 3,653,634 | 4/1972 | Bechi | 254/29 A |
| 3,658,296 | 4/1972 | Yegge | 254/29 A |
| 3,795,949 | 3/1974 | Shorter | 254/29 A |
| 3,811,652 | 5/1974 | Valenzuela | 254/29 A |

*Primary Examiner*—Al Lawrence Smith
*Assistant Examiner*—Robert C. Watson
*Attorney, Agent, or Firm*—Amster & Rothstein

[57] ABSTRACT

This traction actuator is of the take-up type for prestressing concrete. In order to exert tractive effort on a greater number of wire-rope strands, a fixed retaining block and a movable traction block acting on the wire-rope have longitudinal bores formed therein, each bore receiving four or five strands being disposed on a common circumference of the blocks and being each provided on its end faces with bearing plates acting as movable abutment members to keys clamping said strands.

5 Claims, 3 Drawing Figures

TAKE-UP ACTUATOR

BACKGROUND OF THE INVENTION

U.S. Pat. No. 3,653,634 granted Apr. 4, 1972 in the name of applicant discloses a traction actuator or fluid-actuated cylinder for prestressing a concrete member by means of a wire-rope of which the stands are solid with the anchoring members; this actuator operates by successive take-up steps, or in other words by performing an operative traction cycle followed by an inoperative return cycle. To this end the actuator comprises a fixed retaining device and a movable traction device comprising each members for clamping the strands housed in bores formed in these two devices. The clamping members comprise tapered keys or wedges arranged for exerting a tightening action on said strands.

Now keys of the type illustrated in FIG. 3 of the aforesaid patent can be made for anchoring 4, 5, 6, 7, and up to 12 strands, but below 4 and above 12 strands, this type of device is inoperative.

SUMMARY OF THE INVENTION

To avoid this inconvenience, the present invention contemplates means for operating simultaneously **4*n* sets of keys capable of anchoring 4 or 7 strands per set, whereby 4*n* or 7*n*** strands can be enchored simultaneously, without any limitation. However, with this arrangement a strict synchronism between the movements of the anchoring members must be obtained during the operative traction stroke.

To this end, a plurality of bores disposed in-line on a same circumference and capable of receiving each 4 or 5 strands are formed through the fixed retaining device or block and through the movable traction device or block. Furthermore, these devices or blocks comprise at both ends bearing plates assembled by pairs by means of screw-threaded rods engaging the fixed device and the retaining device with a certain clearance corresponding to the movement of the anchoring means during the traction cycle, whereby a synchronous sliding movement of these anchoring means is obtained.

BRIEF DESCRIPTION OF THE DRAWINGS

This arrangement will now be described more in detail with reference to the attached drawing, in which.

DESCRIPTION OF THE PREFERRED EMBODIMENT

Figure 1:
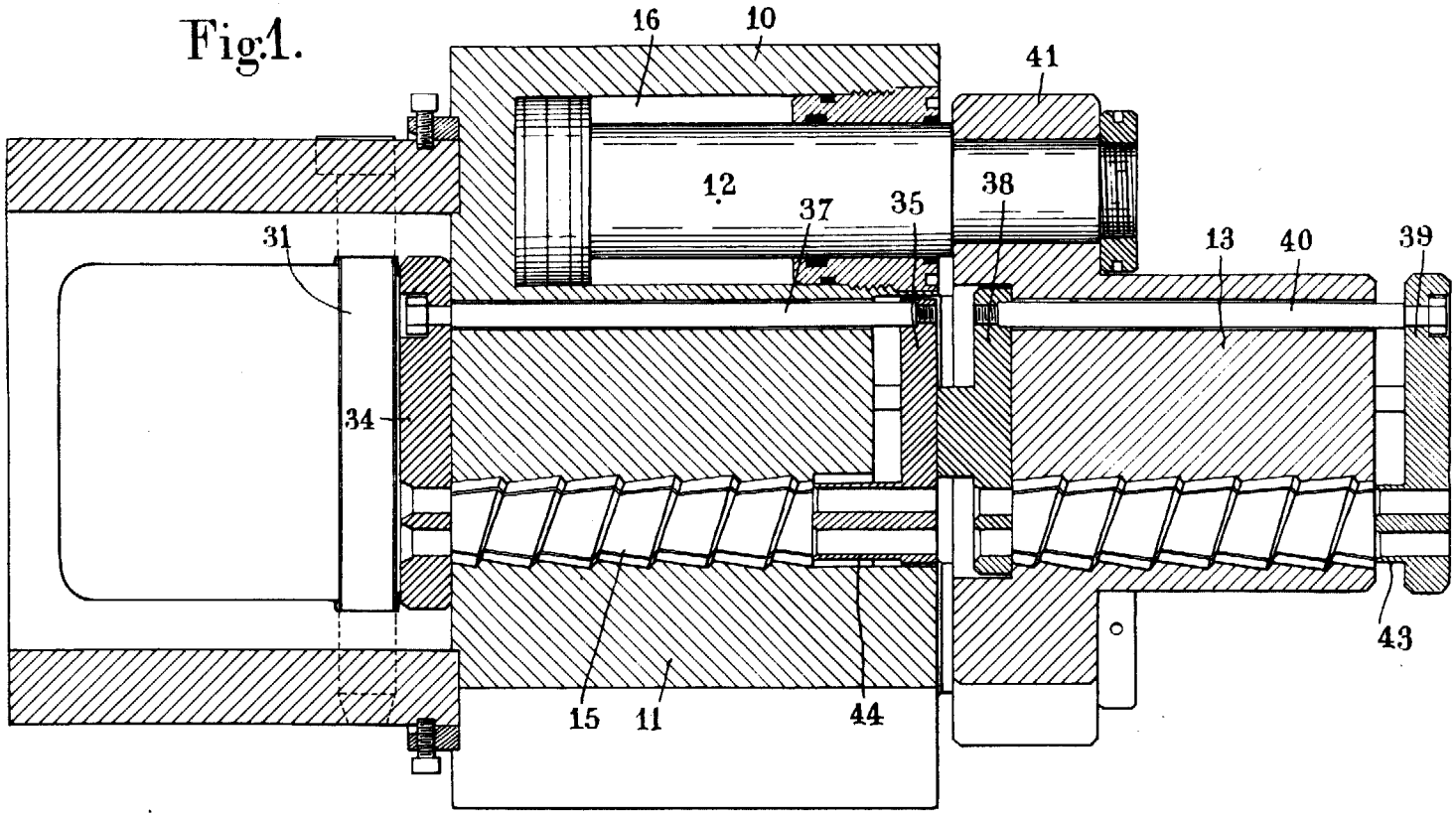
FIG. 1 is a longitudinal sectional view.
Figure 2:
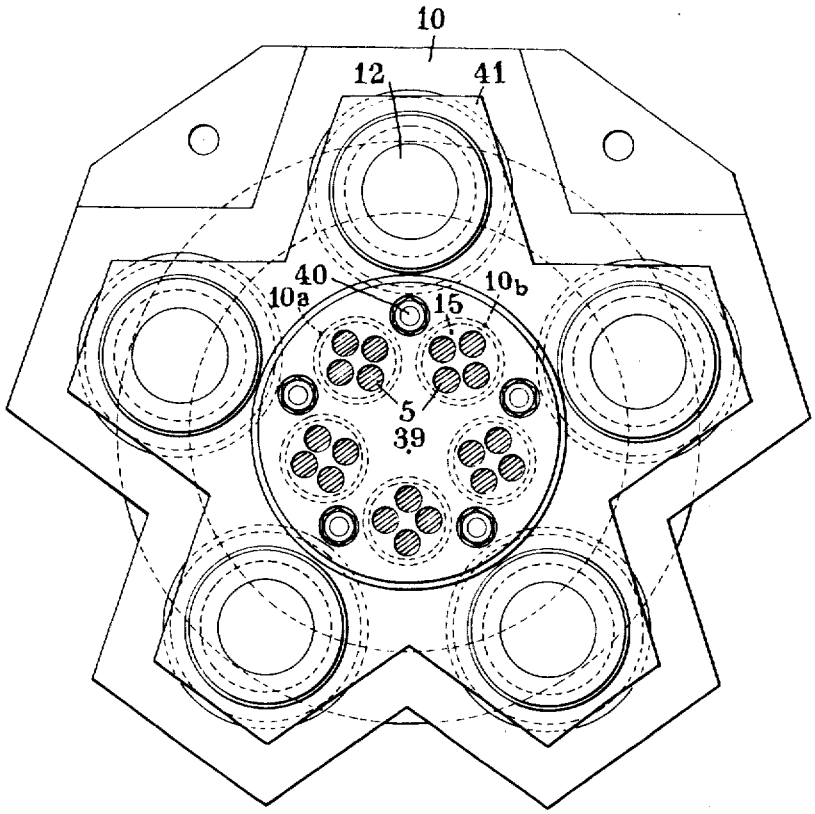
FIG. 2 is an end view.
Figure 3:
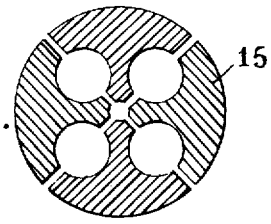
FIG. 3 shows on a larger scale a detail of FIG. 2.

The take-up actuator illustrated in the drawing differs from the device disclosed in the aforesaid patent in that five longitudinal bores **10*a*, 10*b*, . . . 10*e* are formed through the fixed retaining means or sleeves 11 and the movable traction means 13 of the instant invention, each bore receiving four strands 5 of a wire-rope. These bores are aligned on a common circumference. Thus, a 20-strand** device is obtained without running the risk of breaking the strands, since the keys can easily withstand the stress exerted on four or five strands per bore.

However, with this arrangement the necessary or at least desirable synchronism between the movements of said strands in the bores of sleeves 11 and 13 is not obtained. To obtain this synchronism, there are provided on each end face of sleeves 11 and 13 corresponding abutment or bearing plates 34, 35 and 38, 39, respectively, these plates being assembled by means of screw-threaded rods 37 and 40 engaging corresponding holes.

Each set of abutment or bearing plates 34, 35 and 38, 39 is adapted to slide longitudinally with a lateral clearance corresponding to the movements of the anchoring keys 15 in the bores of said sleeves 11 and 13, respectively. These plates further comprise bosses 43 and 44 of a diameter corresponding to the diameter of the bores formed in said sleeves while acting as bearing members to the clusters of keys associated with the five wire-ropes (not shown).

Diametral pins 31 keep the keys 15 of the retaining block in their loose position.

In this exemplary form of embodiment, given by way of illustration, not of limitation, the movable block 13 comprises radial lugs 41 formed with longitudinal bores receiving the corresponding ends of the pistons 12 of the actuators which are disposed circumferentially in cylinders 10 rigid with the retaining block 11 and forming the piston chambers 16, as shown.

This take-up actuator operates exactly like the actuator disclosed in the aforesaid patent.

I claim:

1. A traction actuator comprising:

a fixed retaining block;

a movable traction block coaxially aligned with said retaining block;

each of said blocks including a set of respective aligned longitudinal bores of substantially the same diameter;

each said bore having slidably mounted therein a key tapering from one end to its other end within its respective bore and at least four individual strands extending through each key;

said bores being spaced circumferentially within said blocks;

a pair of first bearing plates, one of said plates mounted in abutting relation with one end of each of said keys located in said fixed block, and the other of said plates having first means mounted in abutting relation with the other ends of said keys;

a pair of second bearing plates, one of said second plates mounted in abutting relation with one end of each of said keys located in said movable block, and the other of said second plates having second means mounted in abutting relation with the other ends of said keys;

a first plurality of rods extending between said pair of first bearing plates to assemble said bearing plates and said fixed block together so that said included set of tapered keys slides in synchronism; and a second plurality of rods extending between said pair of second bearing plates to assemble said second bearing plates and said movable block together so that said included set of tapered keys slides in synchronism.

2. A traction actuator according to claim 1 wherein each bore and respective key includes at least five strands.

3. A traction actuator according to claim 1 wherein said rods are screw-threaded, each said rod having its ends located respectively in one of the pairs of bearing plates.

4. A traction actuator according to claim 3 wherein each said pair of bearing plates is mounted to slide with a predetermined lateral clearance corresponding to lateral movement of said tapered keys.

5. A traction actuator according to claim 1 wherein said first and second means comprise a set of bosses corresponding in number to the number of said bores and each having a diameter corresponding to the diameter of said bores.

* * * * *